US006263947B1

(12) United States Patent
Mullet

(10) Patent No.: US 6,263,947 B1
(45) Date of Patent: Jul. 24, 2001

(54) CABLE CONTROL DEVICE FOR SECTIONAL OVERHEAD DOOR

(75) Inventor: Willis J. Mullet, Pensacola Beach, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 09/488,875

(22) Filed: Jan. 21, 2000

(51) Int. Cl.[7] ..... E05F 15/16
(52) U.S. Cl. ..... 160/191
(58) Field of Search ..... 160/201, 191, 160/192, 193; 254/383; 242/397

(56) References Cited

U.S. PATENT DOCUMENTS

| | | | | |
|---|---|---|---|---|
| 1,489,902 | * | 4/1924 | Segelhorst | 254/383 |
| 1,646,207 | * | 10/1927 | McSheen | 254/383 |
| 2,020,831 | | 11/1935 | Greegor | 20/20 |
| 2,092,774 | * | 9/1937 | Osgood | 254/383 |
| 2,314,015 | | 3/1943 | Parsons | 16/198 |
| 2,946,562 | * | 7/1960 | Handley . | |
| 3,160,200 | | 12/1964 | McKee et al. | 160/189 |
| 3,224,492 | | 12/1965 | Houk | 160/189 |
| 3,248,087 | * | 4/1966 | Hallen | 254/383 |
| 3,367,633 | * | 2/1968 | Kratzer et al. | 254/383 |
| 3,952,965 | * | 4/1976 | Falcon | 242/397 |
| 4,191,237 | | 3/1980 | Voege | 160/188 |
| 4,882,806 | | 11/1989 | Davis | 16/198 |
| 5,419,010 | | 5/1995 | Mullet | 16/198 |
| 5,557,887 | | 9/1996 | Fellows et al. | 49/28 |
| 5,615,723 | * | 4/1997 | Carper | 160/191 |
| 5,636,678 | | 6/1997 | Carper et al. | 160/191 |

FOREIGN PATENT DOCUMENTS

| | | | |
|---|---|---|---|
| 0 716 203 A1 | 6/1996 | (EP) | E05F/15/16 |

* cited by examiner

*Primary Examiner*—Blair M. Johnson
(74) *Attorney, Agent, or Firm*—Renner, Kenner, Greive, Bobak, Taylor & Weber

(57) ABSTRACT

A cable control device (10, 110) in a sectional overhead door (11) having a motor-driven counterbalance system (30) including a spring-loaded drive shaft (31), cable drums (35) carried by the drive shaft, cables (C) attached to and interconnecting the cable drums and the door and forming and releasing cable wraps of the cable on the cable drums upon raising and lowering of the door, and shrouds (10, 110) associated with the cable drums engaging the cable wraps through substantially the circumference of the cable drums to maintain axial alignment of the cable wraps with the cable drums in the event of the development of slack in the cables.

13 Claims, 9 Drawing Sheets

CABLE CONTROL DEVICE FOR SECTIONAL OVERHEAD DOOR

TECHNICAL FIELD

The present invention relates generally to a cable control device for a sectional overhead door. More particularly, the present invention relates to a cable control device for a motor-driven counterbalance system for a sectional overhead door that manages control of the cable orientation with respect to the cable drums in the event of the development of slack in the cables during the operating cycle of the door. More specifically, the present invention relates to a cable control device for a motor-driven counterbalance system for a sectional overhead door wherein the cable wraps formed on the cable drums during raising and lowering of the door are controlled by shrouds associated with the cable drums, which maintain the positioning of cable wraps to prevent displacement of the cable from orderly engagement with the cable drums when slack develops in the cables.

BACKGROUND ART

Counterbalancing systems for sectional overhead doors have commonly employed torsion spring arrangements. The use of torsion springs in such sectional overhead doors is, in significant part, because the linear tension characteristics of a torsion spring can be closely matched to the substantially linear effective door weight as a sectional door moves from the open, horizontal position where the door is largely track supported to the closed, vertical position or vice versa. In this manner, the sum of the forces acting on such a sectional garage door may be maintained relatively small except for momentum forces generated by movement of the door by the application of manual or mechanical forces. In this respect, sectional overhead doors have been provided with lift cables or similar flexible elements attached to the bottom of the door and to cable storage drums at the ends of a drive tube, which rotate when the drive tube is actuated.

In many cases, these cable storage drums have surface grooves that guide the lift cables on and off of the cable storage drum to prevent the coils or cable wraps from rubbing against each other and chafing if positioned in side-by-side engaging relationship or if coiled on top of each other. Lift cables sized to meet operational requirements for sectional overhead door applications are commonly constructed of multiple strand steel filaments that have a pronounced resistance to bending when stored on the circumference of the cable drums and, thus, require tension to remain systematically coiled or wrapped about the cable drums in the grooves therein.

A problem arises if tension is removed from one or both of the lift cables of a sectional overhead door in that the lift cables tend to unwrap or separate from the cable drums; thereafter, when tension is restored, the lift cables may not relocate in the appropriate grooves or the appropriate relation to adjacent cable wraps. In some instances, a cable wrap will locate on a groove further inboard of the door from its original position so that as the door moves to the fully opened position, the cable drum runs out of grooves for cable wraps, such that the lift cable coils about parts of the drum that are not designed for cable storage. In this instance, if the lift cables dislodge from the cable storage drum and engage the smaller radius of the counterbalance system drive tube, the leverage effected by the springs is reduced such that the door will be extremely difficult or impossible to move. This is because the linear force between the door and the counterbalance springs relies on the leverage against the counterbalance spring being applied by the weight of the door operating through the radius of the cable storage drum rather than at a reduced radius portion of the cable drum or the drive tube for the counterbalance system In other instances, the removal of tension from the lift cables can result in cable wraps or coils being displaced to overlie existing cable wraps stored on the cable drum, which may cause the length of cable between the cable drums at opposite ends of a door to assume a different effective operating length. In such case, the door may be shifted angularly in the door opening, with the bottom edge of the door no longer paralleling the ground and the ends of the door sections moving out of a perpendicular orientation to the ground. If thus oriented, continued movement of the door can readily result in the door binding or jamming in the track system and, thus, being rendered inoperative.

In the instance of either of these operating anomalies occasioned by loss of tension in the lift cables, it is probable that the resultant tangling of the lift cables and/or jamming of the doors will prevent the door from further automatic or manual operation, leave the door in a partially open condition, and require qualified service personnel to repair damaged components and realign and assemble the door and counterbalance system components before the door is restored to normal operating condition.

There are a number of possible operating circumstances wherein tension in the lift cables of a counterbalance system for a sectional overhead door becomes reduced to such an extent that the lift cables may become mispositioned on or relative to the cable storage drums, thereby producing the problems discussed above. One example is when a door is rapidly raised from the closed to the open position at a velocity that is faster than the cable storage drums can Totationally react, such that slack is created in the lift cables. Another example is in the utilization of a motorized unit that turns the counterbalance system shaft to open and close a sectional overhead door, such as installations that employ what are termed in the trade as "jack-shaft operators". A jack-shaft may create cable slack when the operator turns the cable storage drum without the door moving, or the door is manually moved without actuating the cable storage drums.

The primary approach to preventing cable mispositioning has involved utilization of grooves in the circumference of the cable storage drums, which are otherwise present for positioning and spacing cable as it is taken up during the raising of a garage door. In some instances, exaggerated or deep grooves have been employed in the cable storage drums in an effort to maintain the lift cables appropriately positioned during a loss of tension on the lift cables. While the use of grooves so configured may be helpful in preventing lift cable mispositioning in minor losses of tension, this approach does not solve the commonly encountered problem of appreciable slack being created in the lift cables.

Another approach to avoid lift cable mispositioning in the event of the creation of cable slack is the use of cable slack take-up devices that compensate for cable slack when it occurs. A device of this type may employ a spring-loaded arm that displaces the cable in a controlled direction to take up any cable slack that might occur, with the controlled direction permitting proper repositioning of the lift cable on the cable storage drum once the slack is operationally eliminated. Normally, however, these designs will take up only minimal amounts of cable slack, and the cable take-up devices, if sensitive enough to be effective, impart a vague or detached component that derogates the desired positive drive positioning of the door during raising and lowering operations. These cable slack take-up devices also tend to require frequent adjustment as a function of component wear of the various components of the cable take-up device.

Another approach to eliminating the problem of cable slack in lift cables contemplates the use of an additional cable or cables connected to the top, as well as the conventional cables connected to the bottom, of a sectional overhead door to create what is sometimes referred to as a closed loop system, wherein the door is pulled open by one lift cable or cables and pulled closed by another cable or cables, with the cable storage Hdrums for all of the cables being attached to the same counterbalance system drive shaft. Attempts to employ this closed loop system design results in the necessity for additional pulleys and hardware at substantial additional cost. In addition, the speed of the two points of attachment to the door are not uniform relative to the drive shaft, at least in areas where the top of the door is traversing the radius from the vertical to the horizontal storage position, while the bottom of the door is moving purely vertically. Such a speed differential requires compensation, such as a spring, which nonetheless may produce notable resistance to door motion. In some instances, the cables of a close loop system may contact the face of the door during a portion of the door travel, which can produce an unsightly mark on the face of the door that is visually apparent on the outside of the door when the door is in the closed position. Thus, no solution to cable slack in sectional overhead door systems having motor-driven counterbalance systems has achieved wide acceptance in the industry and, therefore, motor-driven counterbalance systems for sectional overhead doors have enjoyed only limited usage in the industry.

DISCLOSURE OF THE INVENTION

Therefore, an object of the present invention is to provide a cable control device for a motor-driven counterbalance system for a sectional overhead door that accommodates slack developed in a lift cable without attendant mispositioning of the lift cable on the cable storage drums when tension in the lift cables is restored. Another object of the present invention is to provide such a cable control device in the form of a shroud associated with the cable drums for engaging a portion of the cable wraps or coils in such a manner as to prevent misalignment of the lift cable wraps relative to grooves in the cable drums. A further object of the present invention is to provide such a cable control device wherein a shroud that engages a substantial portion of each of the circumference of each of the cable wraps to thereby positively prevent displacement of each of the cable wraps, which could produce mispositioning of a lift cable when tension is restored.

Another object of the present invention is to provide a cable control device for a motor-driven counterbalance system for a sectional overhead door by providing a cable shroud or snubber that solves a primary problem associated with the utilization of jack shaft operators in conjunction with overhead sectional garage door systems. Yet another object of the invention is to provide such a cable control device that does not require modification or supplemental structure being implemented with respect to the drive motor or counterbalance system. Still a further object of the invention is to provide such a cable control device that eliminates or greatly reduces the possibilities of cable tangling, jamming, and/or door misalignment, which can result in a door being inoperative in an open position and in a condition requiring qualified service personnel and/or replacement parts to return the door to its normal operating condition. Yet a further object of the invention is to provide such a cable control device that in the preferred forms requires only a single part which is installed by manual positioning over the cable storage drum, without the necessity for screws, bolts, or other similar separate fastening elements.

Still another object of the present invention is to provide a cable control device for a motor-driven counterbalance system for a sectional overhead door that may employ a cable storage drum having conventional guide grooves, without the necessity for employing a special cable storage drum having specially configured grooves or like structure, which does not solve the problem of cable mispositioning in the event of substantial temporary cable slack in the operation of such a sectional overhead door. Still a further object of the invention is to provide such a cable control device that does not require the incorporation of springs in the lift cables, which may fail by exceeding the spring cycle life; the presence of attachments to the lift cables; and/or the utilization of a special type of lift cable. Yet another object of the invention is to provide such a cable control device which axially overlies all of the lift cable wraps positioned on a cable drum.

Still another object of the present invention is to provide a cable control device for a motor-driven counterbalance system for a sectional overhead door wherein no moving parts are employed that may require adjustment, can be damaged, and/or can become jammed, thereby negating their normal functioning. Yet a further object of the invention is to provide such a cable control device that does not require additional cables, pulleys, or any other hardware. Still another object of the present invention is to provide such a cable control device that does not affect the counterbalance system or alter its operational performance in a manner that could produce adverse effects on the operation of the door. Still another object of the invention is to provide such a cable control device that is inexpensive, requires no service, and can readily be retrofitted to existing motor-driven counterbalance systems.

In general, the present invention contemplates a cable control device in a sectional overhead door having a motor-driven counterbalance system including, a spring-loaded drive shaft, cable drums carried by the drive shaft, cables attached to and interconnecting the cable drums and the door and forming and releasing cable wraps of the cable on the cable drums upon raising and lowering of the door, and shrouds associated with the cable drums engaging the cable wraps through substantially the circumference of the cable drums to maintain axial alignment of the cable wraps, with the cable drums in the event of the development of slack in the cables.

PREFERRED EMBODIMENT FOR CARRYING OUT THE INVENTION

Figure 1:
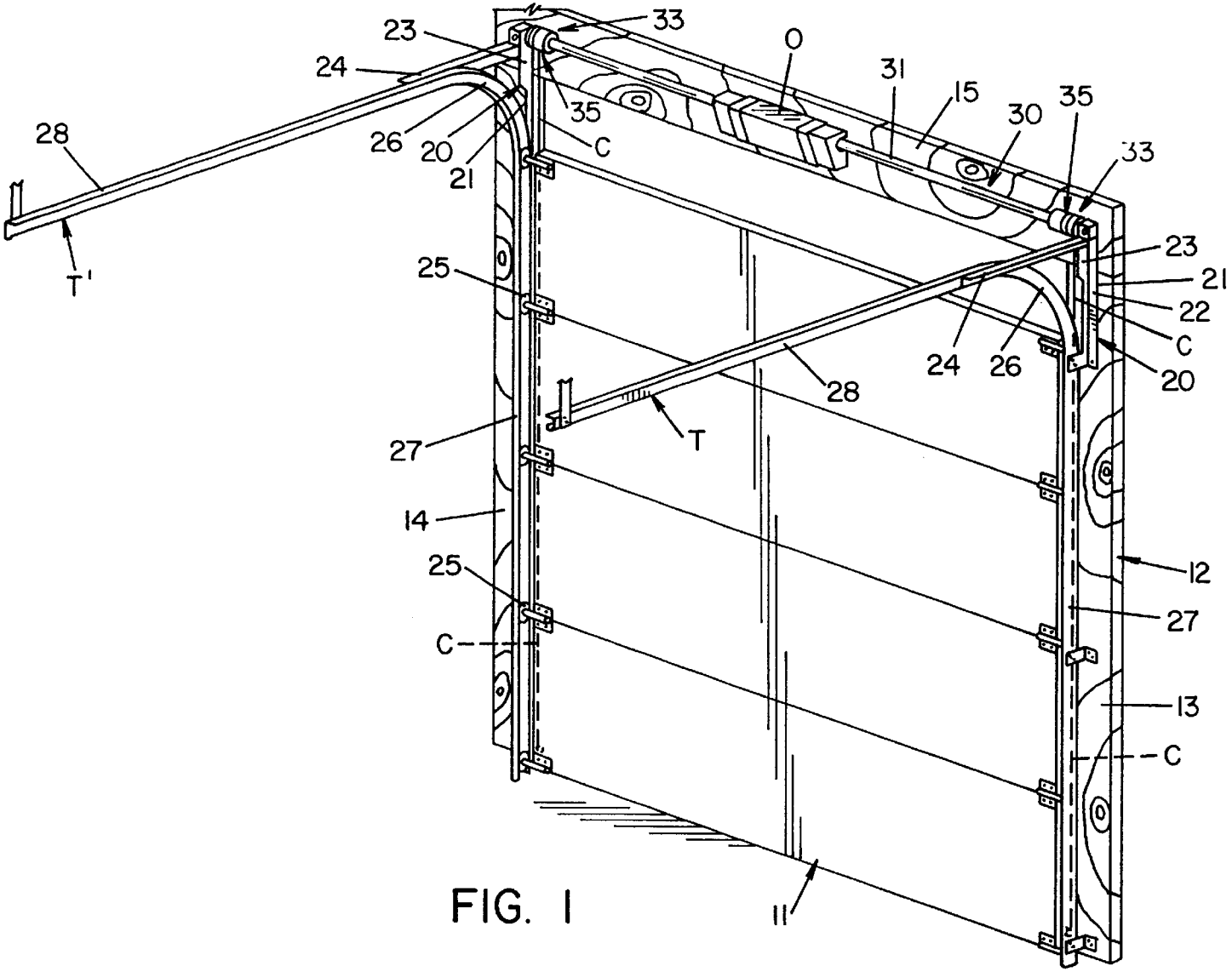
FIG. 1 is a perspective view of an exemplary motor-driven counterbalance system and sectional overhead door that incorporates a cable control device according to the concepts of the present invention.
Figure 2:
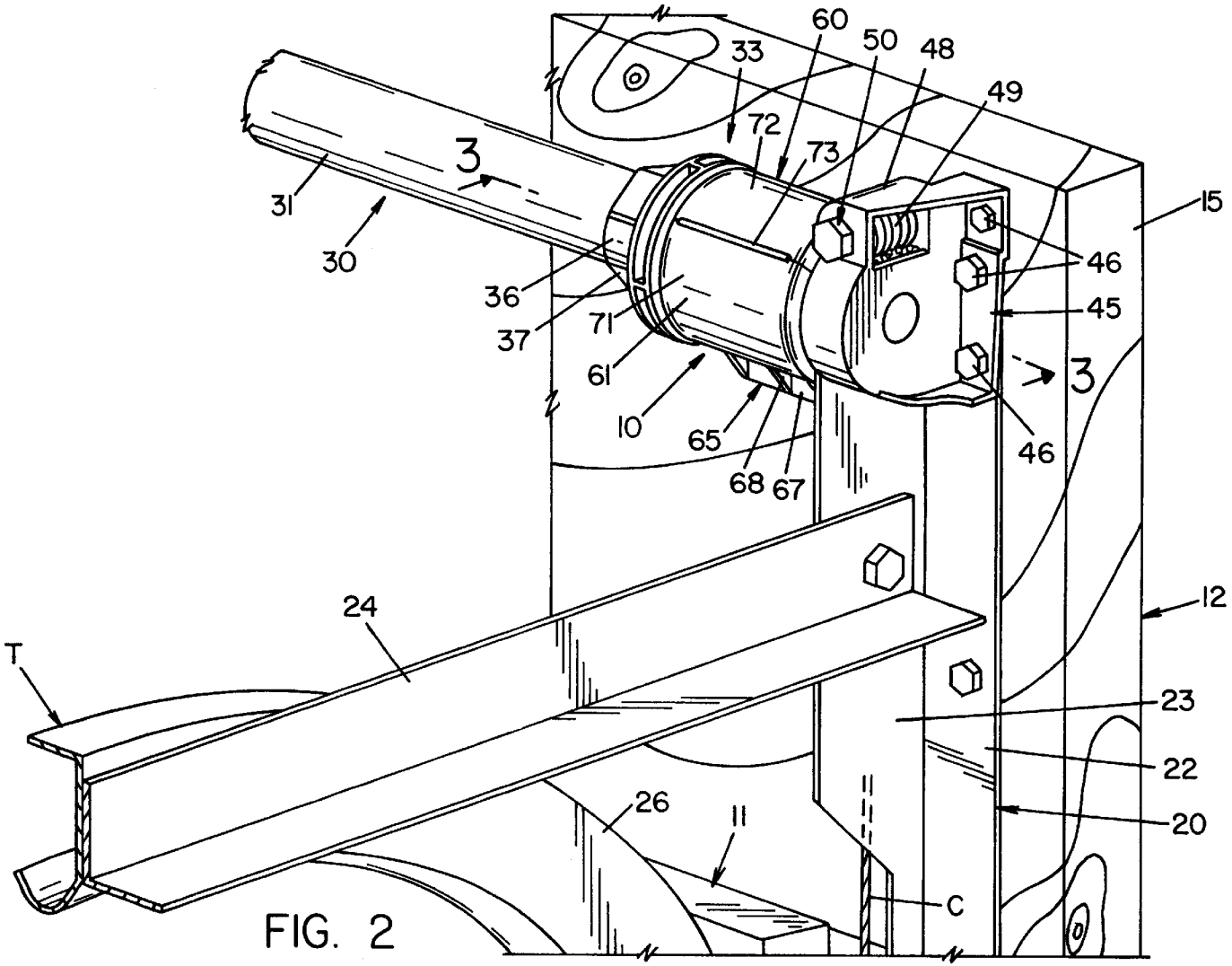
FIG. 2 is an enlarged fragmentary perspective view depicting the cable drum portion of the motor-driven counterbalance system and the interrelation with a cable control device of the present invention.
Figure 3:
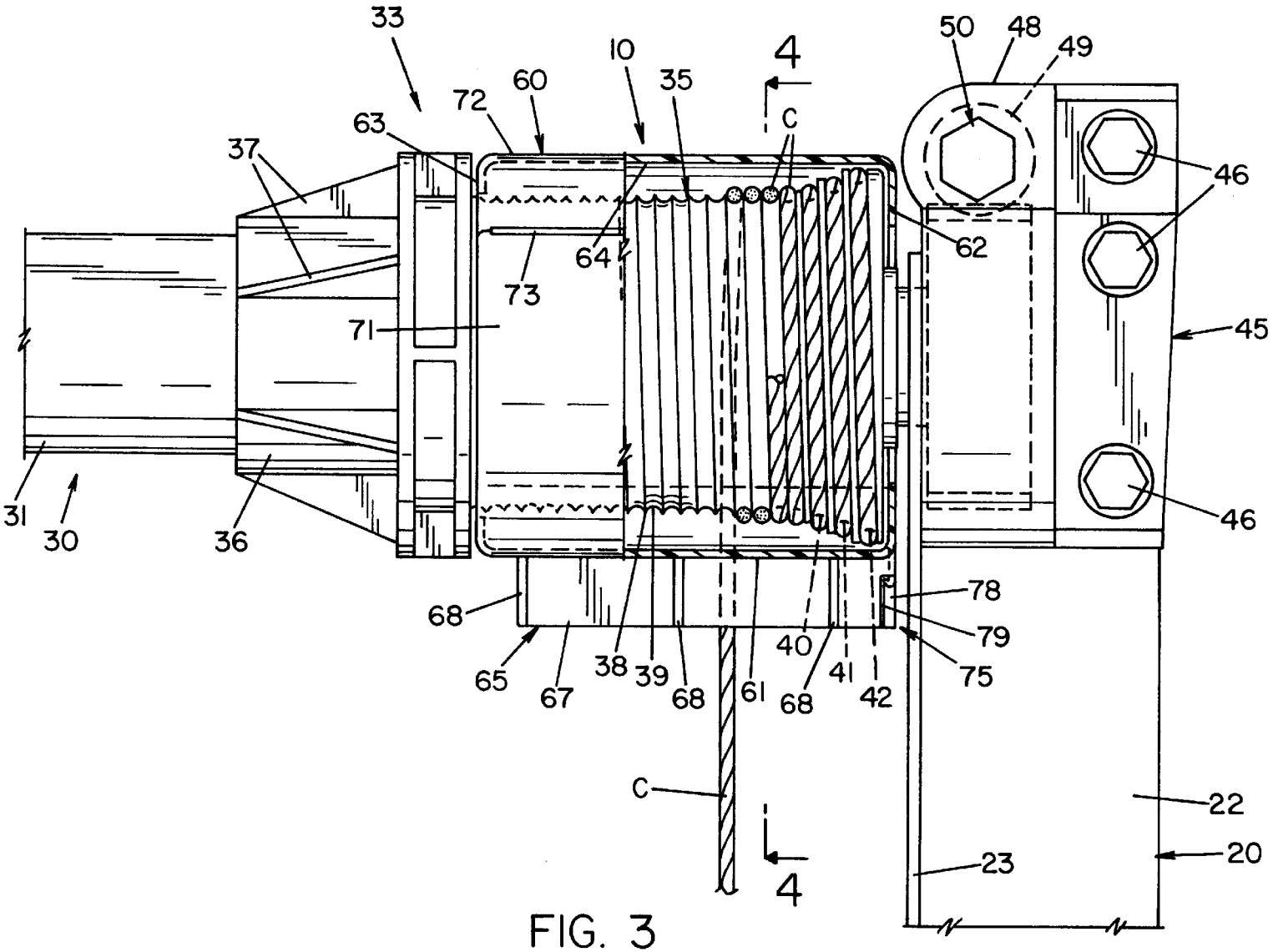
FIG. 3 is an enlarged fragmentary sectional view, taken substantially along the line 3—3 of FIG. 2, showing details of the interrelation of the cable control device of the present invention with the lift cable and cable drum.

A cable control mechanism according to the concepts of the present invention is generally indicated by the numeral 10 in FIGS. 2 and 3 of the drawings. Referring to FIG. 1 of the drawings, the cable control device 10 is shown mounted in conjunction with a conventional sectional door, generally indicated by the numeral 11, of a type commonly employed in garages for residential housing. The opening in which the door 11 is positioned for opening and closing movements relative thereto is defined by a frame, generally indicated by the numeral 12, that consists of a pair of spaced jambs 13, 14 that, as seen in FIG. 1, are generally parallel and extend vertically upwardly from the floor (not shown). The jambs 13, 14 are spaced and joined at their vertically upper extremity by a header 15 to thereby delineate a generally inverted U-shaped frame 12 around the opening for the door 11. The frame 12 is normally constructed of lumber, as is well known to persons skilled in the art, for the purposes of reinforcement and facilitating the attachment of elements supporting and controlling door 11.

Affixed to the jambs 13, 14 proximate the upper extremities thereof and the lateral extremities of the header 15 to either side of the door 11 are flag angles, generally indicated by the numeral 20. The flag angles 20 generally consist of L-shaped vertical leg members 21 having a leg 22 attached to underlying jambs 13, 14 and a projecting leg 23 preferably disposed substantially perpendicular to the leg 22 and, therefore, perpendicular to the jambs 13, 14.

Conventional angle irons 24 are positioned in supporting relation to tracks T, T' located to either side of door 11. The tracks T, T' provide a guide system for rollers 25 attached to the side of door 11 in a manner well known to persons skilled in the art. The angle irons 24 normally extend substantially perpendicular to the jambs 13, 14 and may be attached to a transitional portion 26 of tracks T, T' between a vertical section 27 and a horizontal section 28 thereof or to horizontal section 28 of tracks T, T'. The tracks T, T' define the travel of the door 11 in moving upwardly from the closed to open position and downwardly from the open to closed position.

Figure 4:
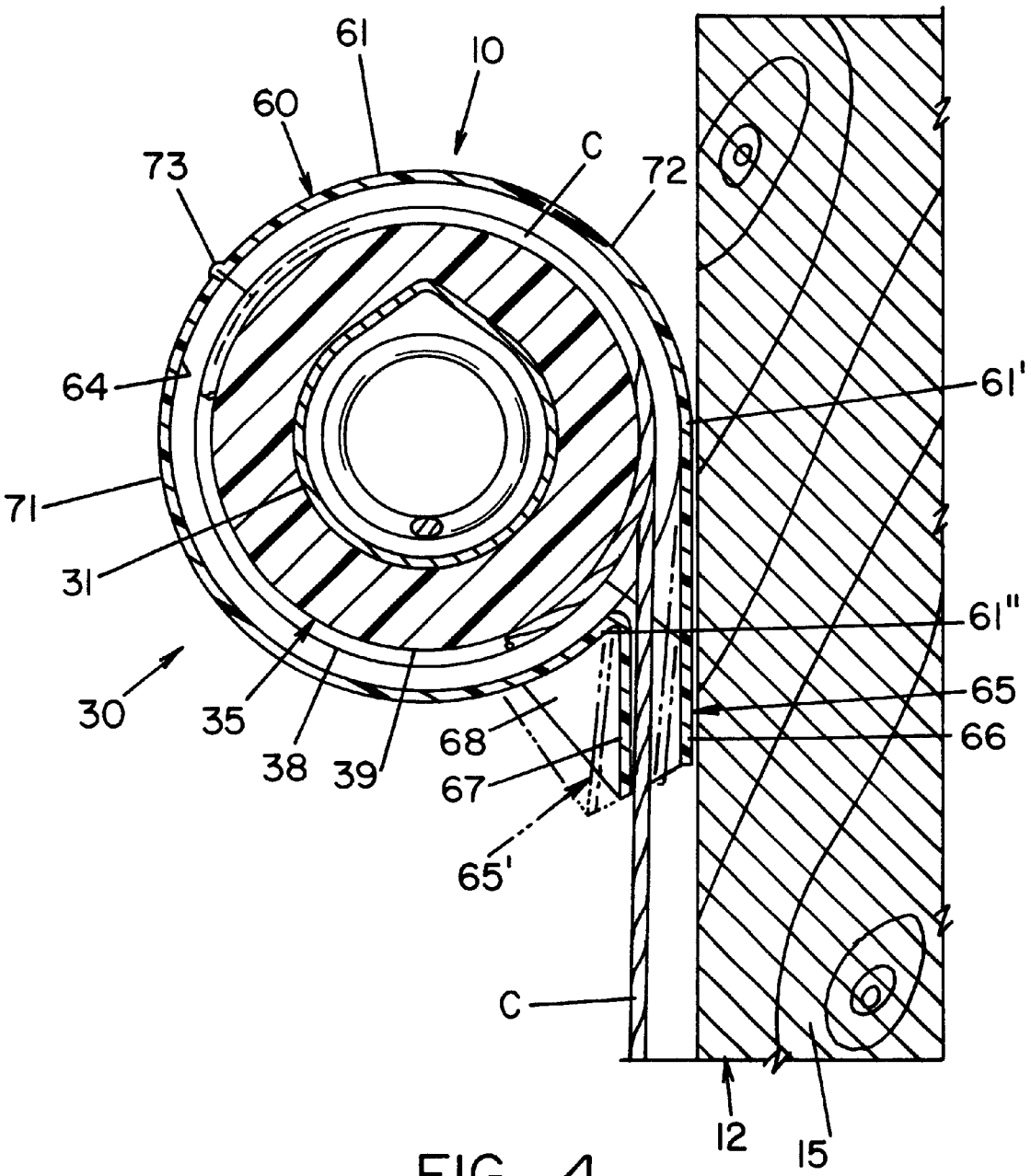
FIG. 4 is an enlarged sectional view taken substantially along the line 4—4 of FIG. 3 showing details of the cable control device and the anti-rotation member therefor.

Still referring to FIGS. 1, and additionally FIGS. 2–4 of the drawings, door 11 has a counterbalance system, generally indicated by the numeral 30. As shown, the counterbalance system 30 includes an elongate drive tube 31 extending between cable drum mechanisms, generally indicated by the numeral 33, positioned proximate each of the flag angles 20. While the exemplary counterbalance system 30 depicted herein is advantageously in accordance with U.S. Pat. No. 5,419,010, which is incorporated herein by reference, it will be appreciated by persons skilled in the art that any of a variety of torsion-spring counterbalance systems could be employed. In any instance, the counterbalance system 30 includes cable drum mechanisms 33 positioned on the drive tube 31 or a shaft proximate the ends thereof which rotate with drive tube 31. The cable drum mechanisms 33 each have a cable C reeved thereabout that is affixed to the door 11 preferably proximate the bottom, such that rotation of the cable drum mechanisms 33 operates to open or close the door 11. The cable C may be attached to a substantially cylindrical drum 35 of cable drum mechanism 33 in the manner described in the aforesaid U.S. Pat. No. 5,419,010. The cable C is preferably a conventional stranded steel cable, which may be coated and, due to its memory characteristics, has a tendency to resist bending in the absence of tension forces acting thereon. The counterbalance system 30 has an operator O, which may conveniently enclose a length of the drive tube 31, as shown, or be a typical jack-shaft operator connected by gears, pulleys, or the like to selectively rotatably power the drive tube 31 or a shaft in a manner well known to persons skilled in the art.

The cable drum 35 of cable drum mechanism 33 has at its inboard end a sleeve 36 having a plurality of circumferentially-spaced, axially-tapered reinforcing ribs 37. The end of drum 35 opposite the sleeve 36 is proximate to the leg 23 of flag angles 20. The drum 35 has a substantially cylindrical outer surface 38 over a substantial portion of its axial length. The drum 35 is provided with continuous helical grooves 39 over the outer surface 38 thereof. The outboard end of drum 35 proximate flag angle 20 may have a plurality of raised grooves 40, 41, and 42 which are of increasing minor diameter.

Counterbalance system 30 has on the outboard side of flag angle 20 an end bracket, generally indicated by the numeral 45, to effect attachment to the flag angle 20 and/or the header 15, as by screws 46 or other suitable fasteners. The end bracket 45 includes a worm shroud 48 which encloses a worm 49 (see FIG. 2) of a tension adjusting mechanism, generally indicated by the numeral 50.

Figure 5:
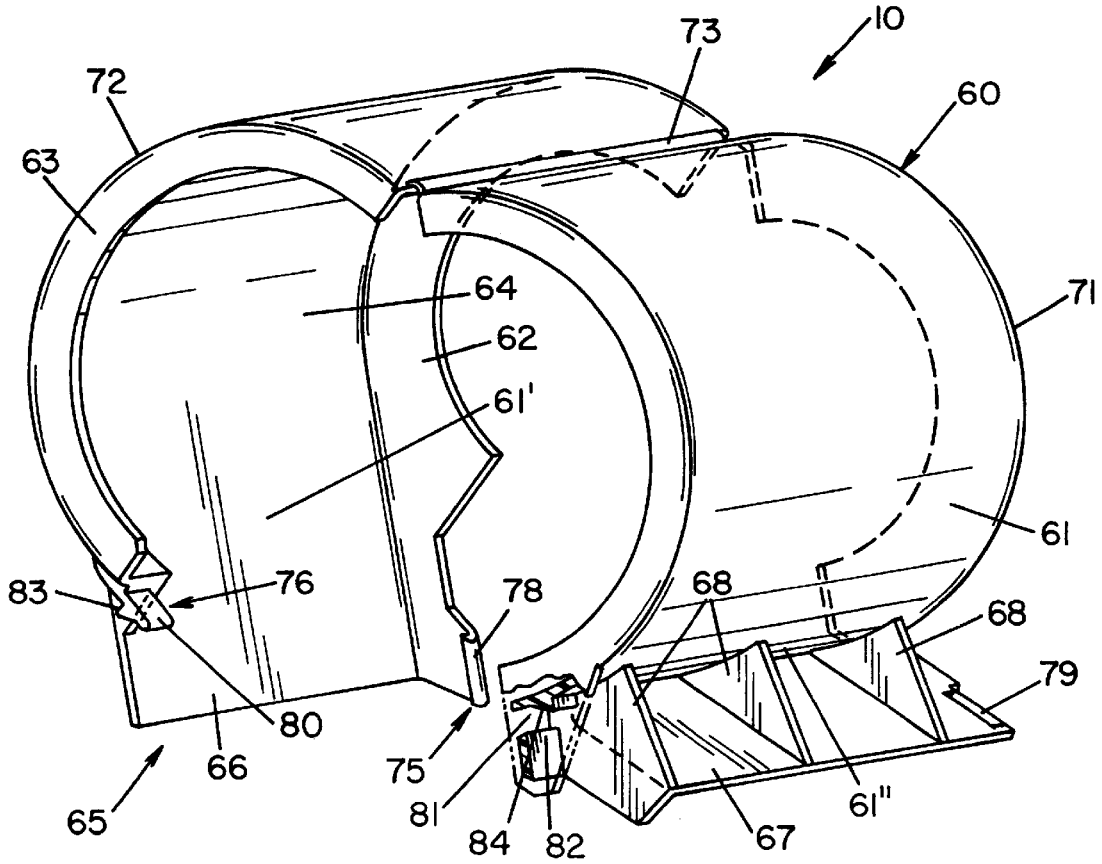
FIG. 5 is a perspective view of the cable control device of the present invention depicting the clam-shell configuration.
Figure 6:
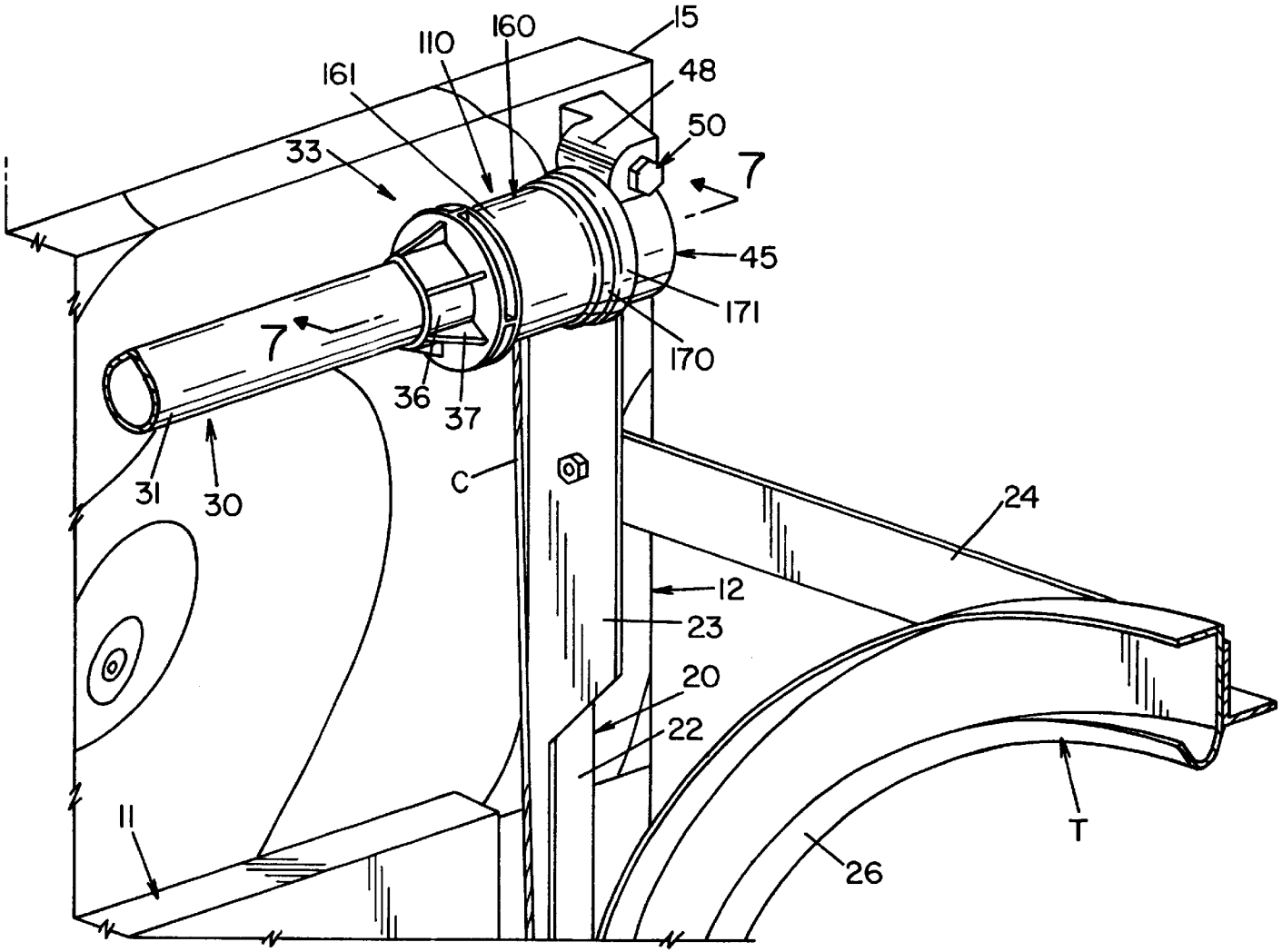
FIG. 6 is an enlarged fragmentary perspective view depicting the cable drum portion of the motor-driven counterbalance system and an alternate form of cable control device according to the concepts of the present invention.

The cable control mechanism 10 is shown in operative relation to the counterbalance system 30 in FIGS. 2–4 of the drawings. The cable control mechanism 10 consists of a drum and cable shroud or retainer, generally indicated by the numeral 60, which may be a shaped piece of metal or plastic that is generally cylindrical in its outer configuration, such as to substantially circumferentially surround the outer surface 38 of drum 35 and the cable C reposing thereon, and of an axial length sufficient to encompass substantially the entire axial length of the drum 35. The shroud 60 has a hood 61 that extends circumferentially about the drum 35 through an angle of approximately 270 to 320 degrees. The hood 61 extends axially between a radially in-turned outboard flange 62 and a radially in-turned inboard flange 63 (see FIGS. 3 and 5). As can be seen in FIG. 5, the flanges 62 and 63 are preferably circumferentially continuous, with the shroud 60 positioned on a drum 35.

The shroud 60 is maintained axially positioned on the drum 35 by the outboard flange 62, which reposes outwardly of the outer end of drum 35, and by the projecting leg 23 of the flag angle 20. The inboard flange 63 of the hood 61 has an internal diameter sized to be loosely supported by the inboard groove 39 of the drum 35 to maintain concentricity of the hood 61 and the drum 35. The outboard end of hood 61 proximate to the outboard flange 62 is sized to extend over the outboard end of drum 35 and particularly the hood 61 as an internal diameter 64, which must radially clear the cable C reposing in raised groove 42, but preferably only slightly. The hood 61 may have a uniform internal diameter 64 thus determined extending for its entire axial length. The wraps of cable C reeved about the drum 35 in the grooves 39 and the raised grooves 40, 41, and 42 are restrained within the hood 61 by the close proximity of internal diameter 64 of hood 61 to thus prevent escape of the cable C proximate the outboard flange 62. The cable C is confined within hood 61 at the inboard end of drum 35 by the inboard flange 63 of hood 61 and its proximity to grooves 39 in drum 35. The positioning of the cable C sequentially in grooves 39 during cable slackening and re-tensioning is controlled by limiting radial expansion of the cable C around the circumference of the drum 35 for at least approximately 270 degrees and up to 320 degrees within the internal diameter 64 of the hood 61. While this circumferential restriction of the cable C is normally sufficient to control location of cable C axially of drum 35, helical grooves (not shown) could be formed on the internal diameter 64 of hood 61 to assist in cable management.

The drum and cable shroud 60 has a guide chute, generally indicated by the numeral 65, which is positioned to permit ingress and egress of the cable C to the hood 61. As such, the guide chute 65 opens generally downwardly toward the ground and is at the lower extremity of hood 61 when mounted on the counterbalance system 30. The guide chute 65 is formed of a tangential lip 66 constituting one circumferential extremity 61' of the cylindrical hood 61 and a cord lip 67 spaced a distance therefrom and preferably substantially paralleling the tangential lip 66. The cord lip 67 extends from a second circumferential extremity 61" of hood 61. As best seen in FIGS. 4 and 5, the flanges 62, 63 are also discontinuous in the area of the lips 66, 67. If desired, the cord lip 67 may have one or more reinforcing strips 68 that interconnect with a circumferential portion of the hood 61. The guide chute 65 is thus generally rectangular in cross section being bounded by lips 66, 67 and portions of flanges 62, 63.

In order to mount and demount the drum and cable shroud 60 on the drum 35 of counterbalance system 30, the hood 61 may be a clamshell-like configuration formed as a first semi-circular half 71 and a second semi-circular half 72, which are preferably joined by a continuous hinge 73. The hinge 73 may be conveniently located substantially diametrically opposite the guide chute 65 of the hood 61. The two hinged halves 71, 72 provide an easy configuration for mounting and demounting on a drum 35 by manually opening and closing by pivoting about hinge 73, although a two-piece configuration could be employed.

Once the shroud 60 is positioned over a drum 35, it is preferably secured in place by an outboard fastening assembly, generally indicated by the numeral 75, and an inboard fastening assembly, generally indicated by the numeral 76. The outboard fastening assembly 75 has a wraparound tongue 78 on the semi-circular half 72, which, when shroud 60 is installed on a drum 35, overlies and engages a groove 79 in the cord lip 67 of the first semi-circular half 71. The inboard fastening assembly 76 includes a projecting tab 80 that selectively engages and disengages a slot 81 formed in the first semi-circular half 71 between the guide chute 65 and the inboard flange 63. As shown, the inboard fastening assembly 76 has a catch 82 that engages a notch 83 on tab 80 when tab 80 is inserted into slot 81. An arcuate ramp 84 to the other side of slot 81 from the catch 82 deflects tab 80 radially outwardly to insure engagement between the catch 82 and the notch 83. It will thus be appreciated that shroud 60 may be mounted on a drum with the fastening assemblies 75, 76 secured to retain the shroud 60 in the operative position depicted in FIGS. 2–4, without the necessity for screws, bolts, or other similar separate fastening elements. It will be appreciated that a variety of fastening assemblies other than the two described hereinabove could be employed for locking shroud 60 in its operative position while permitting unlocking of the fasteners when a shroud 60 is to be demounted from a drum 35 in the event shroud 60 is damaged or it is necessary to perform service on the drum 35 and/or the attachment of cable C. Additionally, while an outboard fastening assembly 75 and an inboard fastening assembly 76 are depicted, it is to be appreciated that a single fastening assembly or additional intermediate fastening assemblies might be employed.

Once the shroud 60 is installed on a drum 35, it will be appreciated that the guide chute 65 serves to limit rotation of the shroud 60, in addition to providing a path for ingress and egress of the cable C. As seen in FIG. 4, rotation of the shroud 60 is limited by the header 15 or cable C as the cable C is reeved about the drum 35 during the raising of the door 11, with the shroud 60 in the solid-line position depicted in FIG. 4. During the release of cable C from the drum 35 when the door 11 is lowered, the shroud 60 tends to rotate to the chain-line position 65' depicted in FIG. 4 where the lip 66 of guide chute 65 engages cable C to limit further rotation of the shroud 60.

The shroud 60 may be made of a wide variety of metallic materials, such as aluminum or steel, as well as polymers, such as PVC or ABS, as long as the material possesses sufficient rigidity to withstand engagement of the chute 65 with a cable C and the normal environmental conditions for a garage door. The use of a polymer may be advantageous if it is desired to create a "living hinge" as the continuous hinge 73 joining the circumferential halves 71, 72.

An alternate form of cable control mechanism is generally indicated by the numeral 110 in FIGS. 6–9 of the drawings. In the instance of cable control mechanism 110, the counterbalance system 30 and door 11, tracks T, and supporting structure such as header 15 may be identical to the structure disclosed and described hereinabove in conjunction with the cable control mechanism 10. These common components depicted in FIGS. 6–9 carry the same numerical designations as employed in relationship to cable control mechanism 10 and related structure shown in FIGS. 1–5 of the drawings. The alternate form of cable control mechanism 110 consists of a drum and cable shroud or retainer, generally indicated by the numeral 160, that is generally cylindrical in its outer configuration, such as to substantially circumferentially surround the outer surface 38 of drum 35 and the cable C reposing thereon, and is of an axial length sufficient to encompass substantially the entire axial length of the drum 35. The shroud 160 has a hood 161 that extends circumferentially about the drum 35 through an angle of approximately 270 to 320 degrees. The hood 161 extends axially between a radially inturned outboard flange 162 and an inboard extremity 163.

The shroud 160 is maintained axially positioned on the drum 35 by radially inturned outboard flange 162, which reposes outwardly of the outer end of drum 35, and by the projecting leg 23 of the flag angle 20. The inboard extremity 163 of hood 161 is confined within the inner boundary of the drum 35. If desired, the inboard extremity 163 of hood 161 could be provided with an in-turned flange in the manner of the shroud 60.

Figure 7:
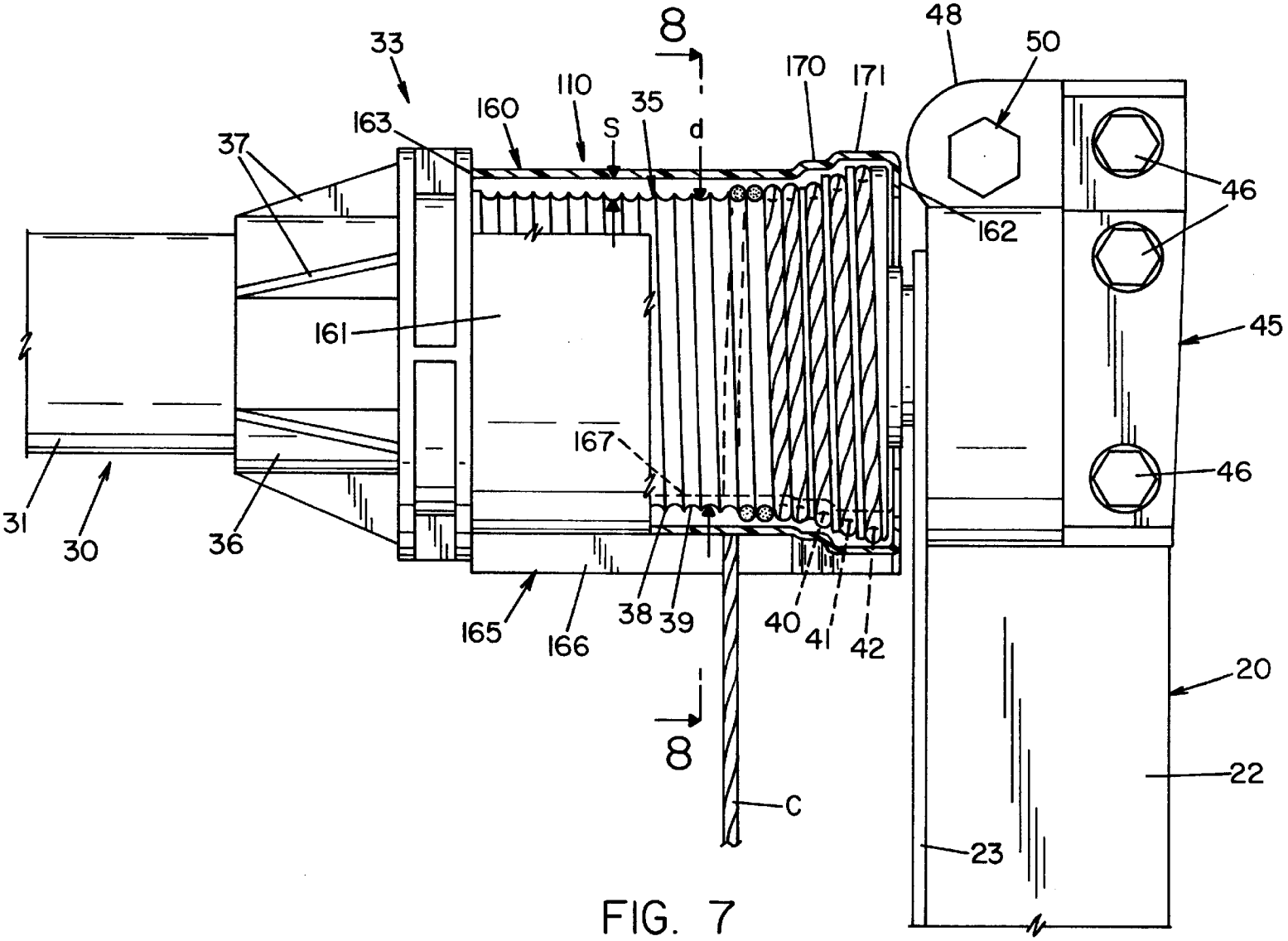
FIG. 7 is an enlarged fragmentary sectional view taken substantially along the line 7—7 of FIG. 6 showing details of the interrelation of the alternate cable control device of the present invention with the lift cable and cable drum.
Figure 8:
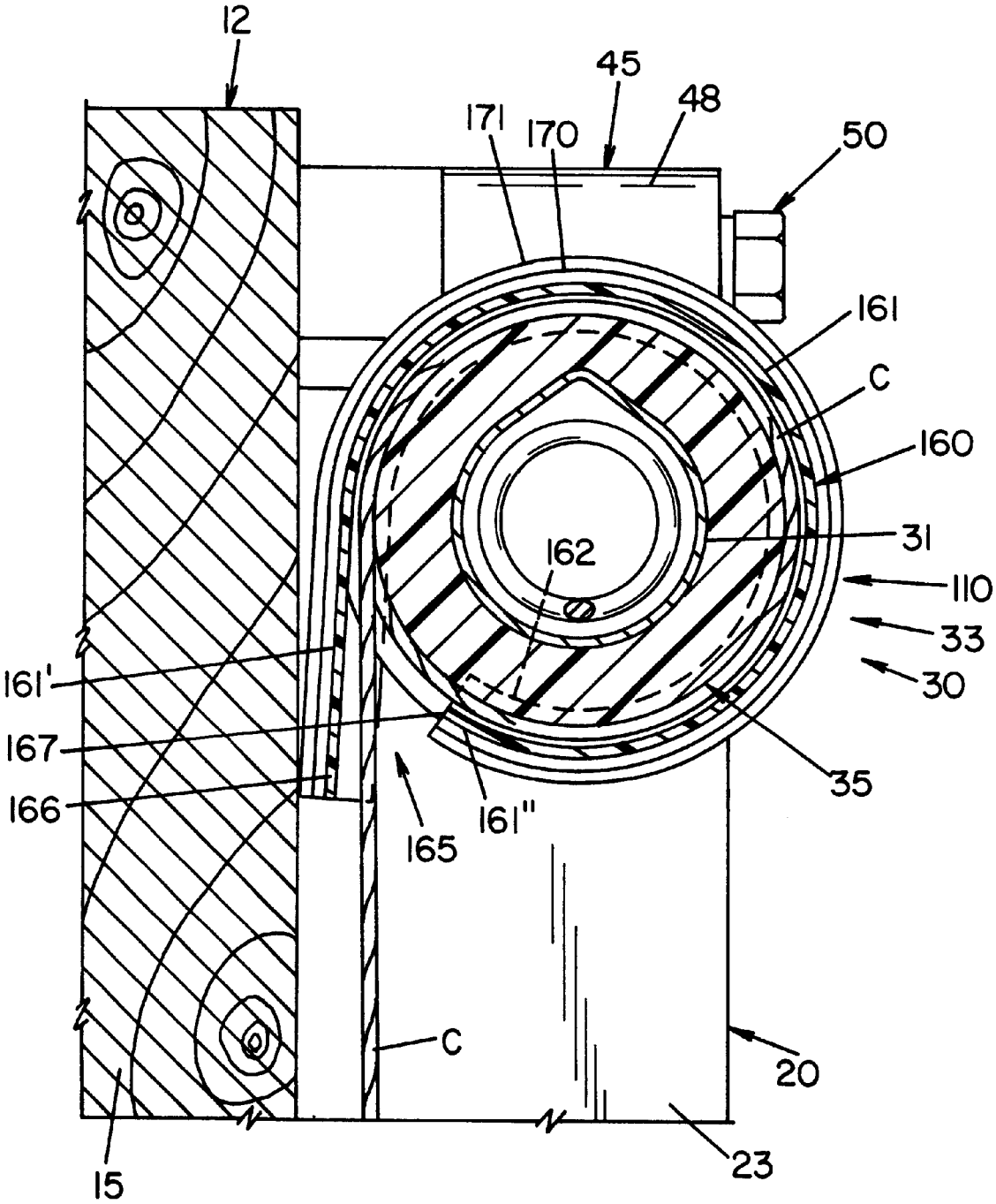
FIG. 8 is an enlarged sectional view taken substantially along the line 8—8 of FIG. 6 showing the interrelation of the alternate cable control device and the cable drum and the anti-rotation member of the cable control device.
Figure 9:
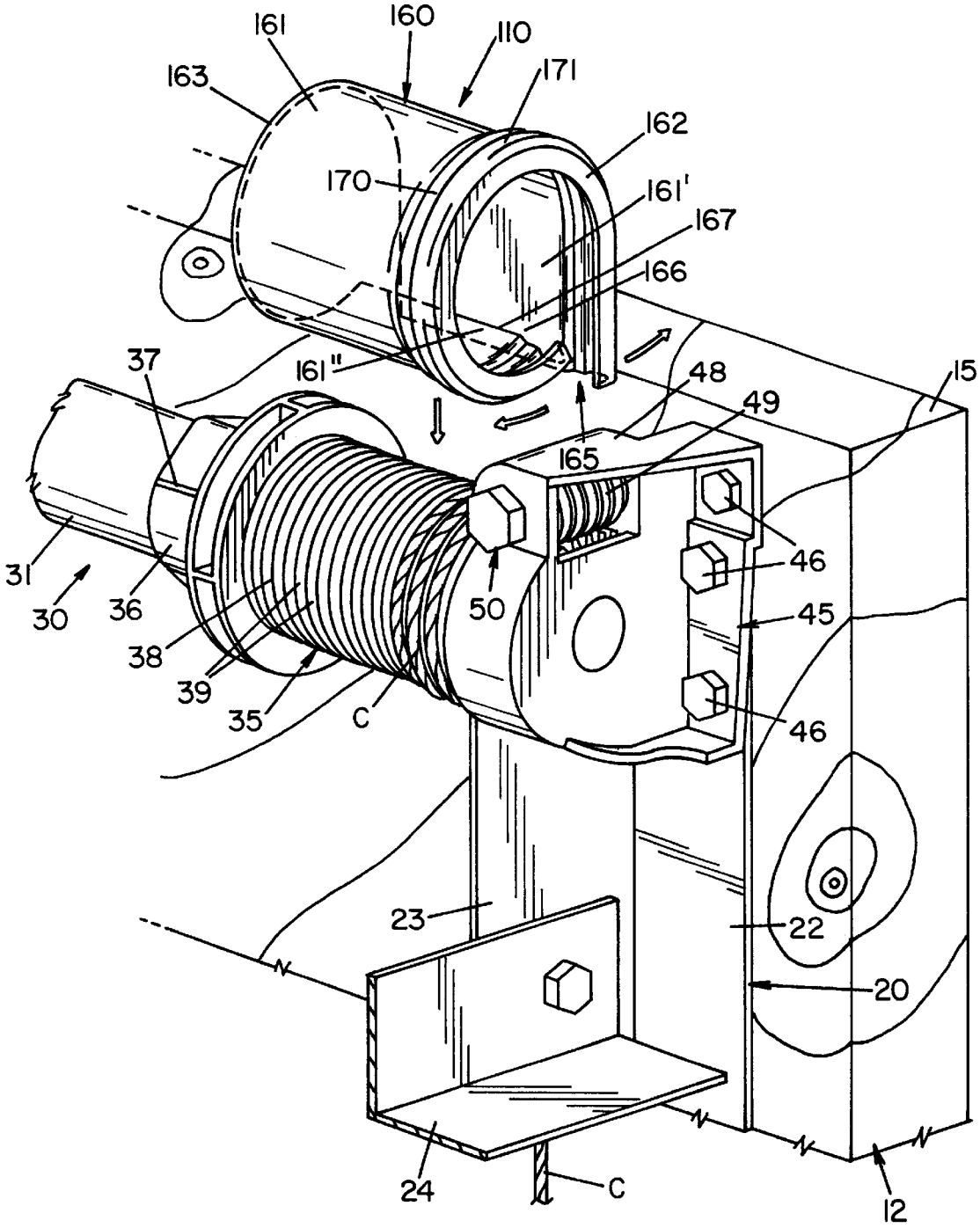
FIG. 9 is an enlarged perspective view of the scroll configuration of the alternate cable control device of FIG. 6 shown in proximity to and preparatory to installation on the cable drum portion of the motor-driven counterbalance system.

The shroud 160 has a guide chute, generally indicated by the numeral 165, which is positioned to permit the ingress and egress of cable C to the hood 161 (see FIGS. 7–9). As such, the guide chute 165 opens generally downwardly toward the ground and is at the lower extremity of hood 161 when mounted on the counterbalance system 30. The guide chute 165 is formed by a tangential lip 166 constituting one circumferential extremity 161' of the cylindrical hood 161 and a terminal lip 167 spaced a distance from tangential lip 166 and constituting a second circumferential extremity 161" of hood 161. The guide chute 165 is thus generally rectangular in cross section, being bounded by the lips 166, 167 and the outboard and inboard extremities of the drum 35.

The positioning of the cable C sequentially in grooves 39 of drum 35 during cable slackening and re-tensioning is controlled by limiting radial expansion of the cable C around the circumference of the drum 35 for approximately 270 up to 320 degrees within the hood 161. While this circumferential restriction of the cable C is normally sufficient to control location of cable C axially of drum 35, helical grooves (not shown) could be formed on the inner surface of hood 161 to assist in cable management. If desired, further cable management can be achieved by configuring the hood 161 relative to the drum 35 at a space S (see FIG. 7), which will allow only a single loop of cable C to repose in each of the grooves 39 and raised grooves 40, 41, and 42 by providing increased diameter segments 170 and 171 of the hood 161. The cylindrical hood 161, in subtending an arc of a circle centered about the axis of drum 35, will have uniform spaces between the minor diameter d of the grooves 39 and 40, 41, and 42 and the radially adjacent portion of hood 161 about substantially the entire circumferential extent of drum 35. It has been empirically determined that the space S is preferably defined as 60 to 80 percent of $^{D-d}/_{2}+c$, where D is the major diameter of the respective grooves in the drum 35; d is the minor diameter of the respective grooves in the drum 35; and c is the diameter of the cable C. In such instance, the relation of the hood 161 to the drum 35 is thus configured to preclude overlap of the wraps of cable C on the drum 35 while avoiding undue friction between the wraps of cable C and hood 161.

In order to mount and demount the shroud 160 on the drum 35 of counterbalance system 30, the hood 161 may be of a scroll-like configuration, which may be temporarily manually expanded to fit over the drum 35 and naturally return to the configuration depicted in the drawings. In particular, the shroud 160 may be positioned as depicted in FIG. 9 preparatory to installation on the drum 35. Thereafter, the tangential lip 166 and the terminal lip 167 may be separated, as indicated by the arrows in FIG. 9. Thereafter, the shroud 160 is moved downwardly, as indicated by the arrow, to encompass the drum 35 and to repose in the position depicted in FIGS. 6 and 7 of the drawings. Shroud 160 is preferably made of a polymer or metallic material of the type described hereinabove in conjunction with the shroud 60, except that the material should have sufficient memory to allow the scroll-like configuration to be opened up or expanded as described hereinabove for installation over the drum 35, while subsequently returning to its original shape. Like the shroud 60, the shroud 160 is advantageously maintained in operative position without the necessity for screws, bolts, or other similar separate fastening elements.

Once the shroud 160 is installed on a drum 35, it will be appreciated that the guide chute 165, and particularly the tangential lip 166, serves to limit rotation of the shroud 160 in addition to providing a path for ingress and egress of the cable C. As best seen in FIG. 8, rotation of the shroud 160 is limited by the header 15 as the cable C is reeved about the drum 35 during the raising of the door 11, with the shroud 160 in the position depicted in FIG. 8. During the release of cable C from the drum 35 as the door 11 is lowered, the shroud 160 tends to rotate counterclockwise, as depicted in FIG. 8, until the tangential lip 166 of guide chute 165 engages cable C to limit further rotation of the shroud 160.

Thus, it should be evident that the various embodiments of the cable control device for sectional overhead door disclosed herein carry out one or more of the objects of the present invention set forth above and otherwise constitute an advantageous contribution to the art. As will be apparent to persons skilled in the art, modifications can be made to the preferred embodiments disclosed herein without departing from the spirit of the invention, the scope of the invention herein being limited solely by the scope of the attached claims.

What is claimed is:

1. A cable control device in a sectional overhead door having a motor-driven counterbalance system comprising, a spring-loaded drive shaft, cable drums carried by said drive shaft, cables attached to and interconnecting said cable drums and the door and forming and releasing cable wraps of said cable on said cable drums upon raising and lowering of the door, unitary shrouds associated with each of said cable drums having cylindrical hoods in close proximity to said cable wraps through substantially the circumference of said cable drums to maintain axial alignment of said cable wraps with said cable drums in the event of the development of slack in said cables, chutes formed in said hoods permitting ingress and egress of said cables to said cable drums and limiting rotation of said hoods relative to said cable drums, an axial discontinuity in said hoods, and an axial hinge in said hoods displaced from said axial discontinuity forming two parts of said hoods being relatively pivotal at said hinge for mounting and demounting on said cable drums.

2. A cable control device according to claim 1, wherein said cable drums have an outer circumferential surface with grooves positioned along an axial extent thereof for receiving said cable wraps.

3. A cable control device according to claim 2, wherein said grooves in said outer circumferential surface are in a helical configuration.

4. A cable control device according to claim 1, wherein said hood extends circumferentially of said cable drums through an arc of approximately 270 to 320 degrees relative to said cable drums.

5. A cable control device according to claim 1, wherein said hood is positioned sufficiently close to said outer circumferential surface such as to preclude overlapping of said cable wraps.

6. A cable control device according to claim 1, wherein each of said cable drums has grooves on the outer circumferential surface thereof and said hood is displaced from the minor diameter of said grooves by 60 to 80 percent of the difference between one half the major diameter of the grooves less one half said minor diameter of the grooves plus the diameter of said cables.

7. A cable control device according to claim 1, wherein said shrouds extend the axial extent of said cable drums.

8. A cable control device according to claim 1, wherein said hood has in-tumed flanges at the axial extremities thereof in sufficiently close proximity to said cable drums such as to preclude axial displacement of said cable from said cable drums.

9. A cable control device according to claim 1, wherein said hood has unitary fastening elements to mount and demount it on said cable drums.

10. A cable control device according to claim 1, wherein unitary fastening assemblies at the axial extremities of said hoods maintain said shrouds positioned on said sable drums.

11. A cable control device according to claim 10, wherein one of said fastening assemblies has a tongue on one of said parts which engages a groove on the other of said parts and the other of said fastening assemblies has a tab on one of said parts which selectively engages a slot on the other of said parts.

12. A cable control device in a sectional overhead door having a motor-driven counterbalance system comprising, a torsion-loaded drive shaft, cable drums carried by said drive shaft, cables attached to and interconnecting said cable drums and the door and forming and releasing cable wraps of said cable on said cable drums upon raising and lowering of the door, and unitary cylindrical hoods associated with said cable drums in close radial proximity to said cable wraps circumferentially continuously through approximately 270 to 320 degrees relative to cable drums and having spaced circumferential extremities so that the remainder of the circumference forms open guide chutes to permit ingress and egress of said cables to said cable drums and to limit rotation of said hoods relative to said cable drums, said hoods being sufficiently flexible to permit temporary separation of said extremities sufficient to permit mounting and demounting of said hoods over said cable drums and having a single radially intumed flange at one axial extremity for maintaining said hoods axially positioned on said cable drums.

13. A cable control device according to claim 12, wherein one of said extremities has an outwardly projecting tangential lip for engaging said cables and orienting said hoods.

* * * * *

UNITED STATES PATENT AND TRADEMARK OFFICE

CERTIFICATE OF CORRECTION

PATENT NO. : 6,263,947 B1
DATED : July 24, 2001
INVENTOR(S) : Willis J. Mullet

It is certified that error appears in the above-identified patent and that said Letters Patent is hereby corrected as shown below:

Column 11,
Line 6, the word “sable”, should be -- cable --.

Signed and Sealed this

Twenty-sixth Day of October, 2004

JON W. DUDAS
*Director of the United States Patent and Trademark Office*